US010455901B2

(12) United States Patent
Marin

(10) Patent No.: US 10,455,901 B2
(45) Date of Patent: Oct. 29, 2019

(54) INTERCHANGEABLE BUTTON SYSTEM TECHNOLOGY

(71) Applicant: Anibal Marin, Baldwin, NY (US)

(72) Inventor: Anibal Marin, Baldwin, NY (US)

( * ) Notice: Subject to any disclaimer, the term of this patent is extended or adjusted under 35 U.S.C. 154(b) by 306 days.

(21) Appl. No.: 15/314,064

(22) PCT Filed: Dec. 18, 2015

(86) PCT No.: PCT/US2015/066640

§ 371 (c)(1),
(2) Date: Nov. 25, 2016

(87) PCT Pub. No.: WO2016/109249

PCT Pub. Date: Jul. 7, 2016

(65) Prior Publication Data

US 2017/0196313 A1 Jul. 13, 2017

Related U.S. Application Data

(60) Provisional application No. 62/099,554, filed on Jan. 4, 2015, provisional application No. 62/161,247, filed on May 13, 2015.

(51) Int. Cl.
*A44B 1/14* (2006.01)
*A44B 1/34* (2006.01)

(52) U.S. Cl.
CPC . *A44B 1/14* (2013.01); *A44B 1/34* (2013.01)

(58) Field of Classification Search
CPC ..... A44B 1/14; A44B 1/34
See application file for complete search history.

(56) References Cited

U.S. PATENT DOCUMENTS

| | | | | |
|---|---|---|---|---|
| 136,882 A * | 3/1873 | Thurber | A44B 1/30 24/105 |
| 485,848 A * | 11/1892 | Perrine | A44B 1/34 24/108 |
| 488,219 A | 12/1892 | Platt | |
| 1,349,649 A | 8/1920 | Arthur | |
| 1,368,065 A | 2/1921 | Sorensen | |
| 1,548,250 A | 8/1925 | Bobner | |
| 1,598,597 A | 9/1926 | Baggerud | |
| 1,661,520 A | 3/1928 | Wullum | |

(Continued)

FOREIGN PATENT DOCUMENTS

| | | |
|---|---|---|
| EP | 2078469 A2 | 7/2009 |
| FR | 2702342 A1 | 9/1994 |

*Primary Examiner* — Robert Sandy
*Assistant Examiner* — Louis A Mercado
(74) *Attorney, Agent, or Firm* — Brown & Michaels, PC

(57) ABSTRACT

A interchangeable button system that has an interchangeable cap, a base button and a pronged fastener allowing the user to change the appearance and functionality of buttons, quickly and conveniently without sewing. The pronged fastener penetrates fabric exposing the prong tips for alignment with the base buttonholes located on the base button. Compression on the base button couples the pronged fastener with the base buttonholes creating a secure permanent attachment. The base button has an external base thread that aligns with internal cap thread for coupling. Thus the interchangeable cap can be torqued on or off. Different functional decorative and technological types of interchangeable caps may be selectively torqued onto base button for end use.

16 Claims, 9 Drawing Sheets

(56) References Cited

U.S. PATENT DOCUMENTS

| | | | | |
|---|---|---|---|---|
| 2,228,043 | A | 1/1941 | Baggerud | |
| 2,244,287 | A | 6/1941 | Carley | |
| 2,453,227 | A | 11/1948 | Janes | |
| 2,713,187 | A | 7/1955 | Chaves | |
| 2,713,707 | A | 7/1955 | Libby | |
| 3,141,211 | A | 7/1964 | Blake | |
| 3,500,507 | A | 3/1970 | Malhenzie | |
| 3,583,039 | A | 6/1971 | Walker | |
| 3,715,781 | A | 2/1973 | Salvatori | |
| 3,725,980 | A | 4/1973 | Burgio | |
| 3,787,935 | A | 1/1974 | Kapitan | |
| 4,035,874 | A | 7/1977 | Liljendahl | |
| 4,097,969 | A | 7/1978 | Nysten | |
| 4,471,510 | A | 9/1984 | DeRosa | |
| 4,481,696 | A | 11/1984 | Kanzaka | |
| 4,541,148 | A | 9/1985 | Watanabe | |
| 4,662,033 | A | 5/1987 | Wieland, Jr. et al. | |
| 4,683,621 | A | 8/1987 | Watanabe | |
| 4,777,704 | A | 10/1988 | Acker | |
| 4,969,241 | A | 11/1990 | Griffin | |
| 4,970,766 | A | 11/1990 | Hsiau et al. | |
| 5,189,762 | A | 3/1993 | Giancaspro | |
| 5,195,336 | A | 3/1993 | Mershon | |
| D337,255 | S | 7/1993 | Novelli, Sr. | |
| D337,967 | S | 8/1993 | Wright | |
| D344,252 | S | 2/1994 | Choi | |
| D361,170 | S | 8/1995 | Hashimoto | |
| 5,526,551 | A | 6/1996 | Herman | |
| 5,584,104 | A | 12/1996 | Stuart | |
| 6,266,853 | B1 | 7/2001 | Ho | |
| 7,788,772 | B2 | 9/2010 | Dandurand | |
| 7,856,697 | B2 | 12/2010 | Quimod | |
| 8,402,605 | B2 * | 3/2013 | Courtin | B60N 3/046 16/4 |
| 8,438,951 | B1 | 5/2013 | Mccabe | |
| 8,522,404 | B2 | 9/2013 | Matei | |
| 8,769,775 | B2 | 7/2014 | Rantfors | |
| 9,269,510 | B2 | 2/2016 | Andrews | |
| D781,178 | S | 3/2017 | Harpole | |
| 9,844,245 | B1 * | 12/2017 | Naylor | A44B 1/14 |
| 9,961,966 | B2 * | 5/2018 | Ryan | A44B 1/14 |
| 2006/0162133 | A1 | 7/2006 | Takamura | |
| 2007/0256280 | A1 | 11/2007 | Azan | |
| 2009/0052167 | A1 | 2/2009 | Ono | |
| 2010/0191072 | A1 | 7/2010 | Matsumori | |
| 2011/0061207 | A1 | 3/2011 | Forbes | |
| 2015/0237968 | A1 | 8/2015 | Liammari | |

* cited by examiner

INTERCHANGEABLE BUTTON SYSTEM TECHNOLOGY

BACKGROUND OF THE INVENTION

Field of the Invention

The invention pertains to the field of clothing and accessory buttons. More particularly, the invention pertains to an interchangeable button system that attaches with a fastener replacing the sewing operation and allowing the facing of the button to be changed quickly, serving decorative or utility functions.

Description of Related Art

It is a very time consuming and fabric-deteriorating task to change the appearance of the buttons which are sewn on garments and accessories. On average, the changing of sewn-on buttons on a garment or accessory occurs once during the lifetime of the garment or accessory, and is mainly for repair purposes. For those who have no knowledge of sewing or users with visual impairment, sewing a button correctly onto a shirt can be extremely difficult.

Therefore, replacing the aesthetic or function of sewn on buttons without the sewing operation to compliment or enhance a garment or accessory in a quick manner is desirable. The garment and accessories industry have long sought an effective quick changing button system and more so, an interchangeable button system that can be applied without sewing.

Interchangeable button covers, detachable buttons and fasteners have taken on a variety of constructions and configurations. There exist many different solutions attempting to solve the above-mentioned problems. However, none of these solutions seemed to have solved the problems in combination or without the use of special tools, creating disadvantages.

The first group of configurations is quickly attachable buttons with pronged fasteners that have shank projections on the back of the button. These kinds of configurations are more commonly seen on heavier denim or outerwear because of the stiffness and support of the shank projections. The pronged fasteners limit flexibility and ergonomic maneuverability for closure of dual layered fabrics, smaller buttons and tighter button holes. This first group may be represented by Perrine, U.S. Pat. No. 485,848, Weiland, Jr., U.S. Pat. No. 4,662,033, and Lajmerim FR2702342, which all have one pronged fasteners not suitable for button interchangeability.

In Liljendahl, U.S. Pat. No. 4,035,874, a button body has a shank with the added ability for changing the head in conjunction with a locking plate. However, the head and button body limits the coverage options of the interchanging heads and requires a special drive pin along with a locking plate making it a complex task. Furthermore, the hooked shaped projections of the pin heads are partial, minimizing gripping strength when applied to the button body.

There is also known from Thurber, U.S. Pat. No. 136,882, a threaded shank that passes through fabric and screws into a nut on the backside of the garment to anchor the button in place. This assembly requires that a hole be positioned in fabric permitting passage of the threaded shank. This arrangement causes severe wear to the punctured area weakening the fabric over time. In addition, the nut is only stationary when used in conjunction with the threaded shank, creating the possibility of losing either piece when not in use. Furthermore, this process of application is unfavorable for current day manufacturing.

The second group of configurations are attachable button assemblies with a single pronged fastener. In Burgio, U.S. Pat. No. 3,725,980, the entire structure is difficult to dismember and creates the potential for losing all the parts. In Hsiau, U.S. Pat. No. 4,970,766, the serrated prong is exposed when fully inserted into the female element requiring a special tool for cutting off the excess point. This process is time consuming and if done improperly can leave undesired results.

The third group of configurations is changeable button assemblies without fastening devices. These known configurations are generally formed from two elements, specifically a cover and retainer base. In Chaves, U.S. Pat. No. 2,713,187 the button cover snaps in place with the retainer base sewn to the garment by means of a stud. The stud method of sewing is less desirable, not used in a majority of applications and is more susceptible to breaking with a constantly interchanging cover. Similarly, in DeRosa, U.S. Pat. No. 4,471,510, a button cover of the aforementioned type, is also constructed from a detachable button head and a base section. The button cover slides tightly into registration with a base, interlocking the two pieces. As a consequence of this slide-on arrangement, seams caused by the joining of the button cover and base, lead to an unpleasant and non-conventional button aesthetic. In addition, the smaller the button, the more difficult it would be to accurately register the two parts.

There is also known from Walker, U.S. Pat. No. 3,583,039, a two-piece changeable button structure comprised of a base part and a cap part. The base and cap parts are coupled together by means of interrupted screw threads. The interrupted screw threads pose quite a few disadvantages. Initially registering the flanges to align the interrupted threads is time consuming and can lead to misregistration of the helical thread. Interrupted helical threads are difficult to manufacture and are much easier to damage with constant twisting. In addition, if the cap part is lost, the edges of the interrupted threads can damage fabric and button holes. Furthermore a pointed tool is needed to engage and disengage the interrupted thread elements. This can cause extreme wear if fastened by thread.

Similarly in Sidoti, EP2078469A2, the stationary base and interchangeable cap are coupled together by means of registering the base flaps and cap notches and rotating them into a locked position. Initially registering the base flaps to the cap notches is time consuming, specifically if the base is attached by thread creating an unstable platform. In addition, if the cap part is lost, the edges of the base flaps can damage fabric and button holes.

The fourth group of configurations is button fasteners intended to eliminate the need of a needle and thread for conventional buttons. In Stuart, U.S. Pat. No. 5,584,104, spearheads are compressed through the fabric and into the female element of the button. The spearhead is exposed when fully inserted into the female element requiring a special tool for cutting off or flattening the excess point. In a further embodiment, a locking plate is used. Both processes are time consuming and if done improperly can leave undesired results or change the full appearance of the button.

Also known from Rantfors, U.S. Pat. No. 8,769,775, is a button fastener having a u-shaped penetrating part and a u-shaped receiving part attached to a gripping member. The gripping member is detached by means of rupture once the two u-shaped parts are interlocked. This fastening system couples onto itself independently from any button and is susceptible to greater movement and strain. It is specifically inadequate for an interchangeable button system that is constantly pressured, pulled and torqued in non-standard button requirements. In addition there is high material wastage by discarding the gripping members leading to an inefficient and non-sustainable product for manufacturing.

Further known is Baggerud, U.S. Pat. No. 1,598,597, which discloses a U-shaped barbed loop which is inserted into the face of the button, penetrating the fabric and gripping the lock plate of the button lock. This particular configuration can be frustrating to register and provides no backing to the u-shaped barbed loop for maximum compression. An additional disadvantage is that the barbed loop is relatively difficult to handle due to the fact that the parts must be relatively small.

The prior art does not provide a button system with both interchangeability and fastening which is closest in appearance to, functionality of and ease of use to conventional buttons.

SUMMARY OF THE INVENTION

In an embodiment of the present invention, an interchangeable button system with a fastener is provided which is decorative, universal, and quickly interchangeable for a variety of products without the need of sewing.

The interchangeable button assembly system may include a pronged fastener that penetrates a material coupling to a button base. The pronged fastener and button base become permanently affixed to the material allowing mating with an interchangeable button cap until securely tightened. Embossed designs on the rear of pronged fastener base provide grip creating maximum torquing stability when interchanging button caps. The interchangeable button cap can be replaced indefinitely, changing the appearance and function of a button quickly.

The interchangeable button system may be used in safety applications such as but not limited to, reflective properties on a button face for high visibility, utilitarian functions, signaling, ranking, etc.

In another embodiment of the present invention, the interchangeable button system is preferably utilitarian in nature, and may embed technology into an interchangeable button cap. The technology may be non-self-powered micro devices such as passive radio frequency identification (RFID) tags, near field communication (NFC) devices, microdot devices, or the like. Alternatively, the technology may be independently electrically charged micro devices such as light emitting diodes (LEDs), wireless transceivers, medical devices, batteries, active radio frequency identification (RFID) transponders, or the like, into an interchangeable button cap for changing and storing information.

DETAILED DESCRIPTION OF THE INVENTION

Figure 1A:
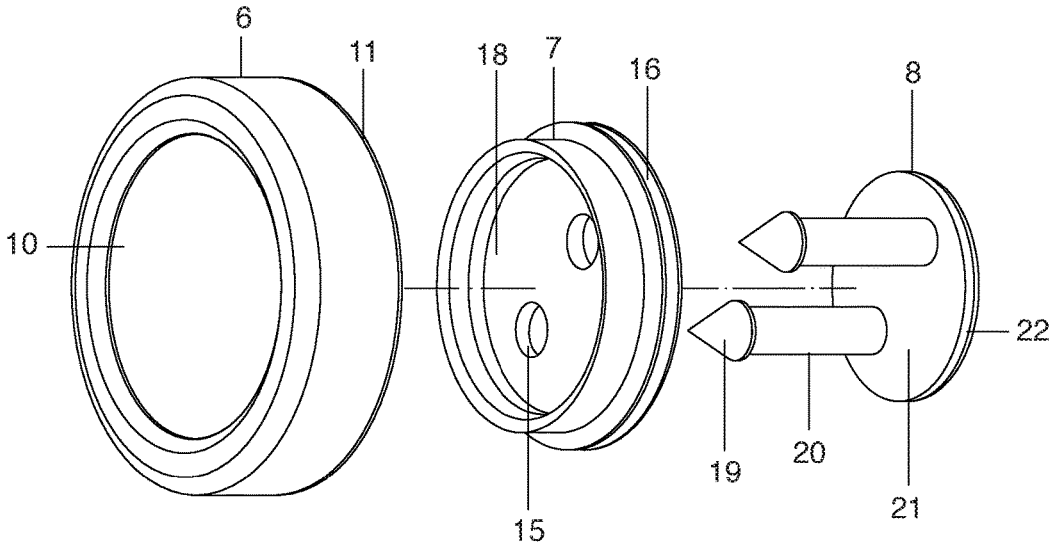
FIG. 1A shows an expanded, front perspective view of the interchangeable button.
Figure 1B:
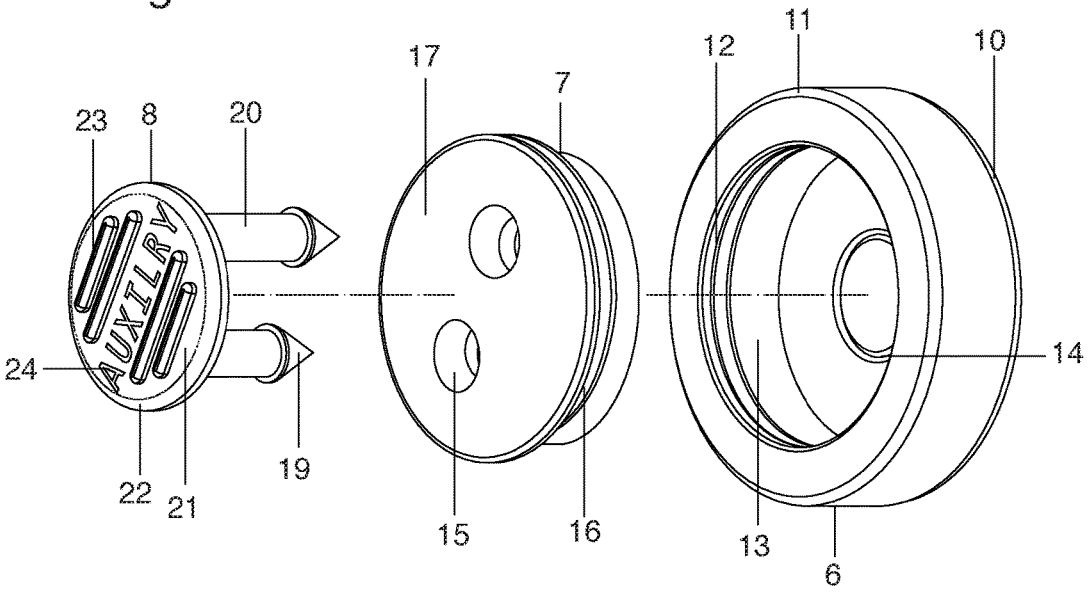
FIG. 1B shows an expanded, back perspective view of FIG. 1A.

FIGS. 1A-1K shows an interchangeable button system of a first embodiment of the present invention. The interchangeable button system has an interchangeable cap 6, a base button 7 and a pronged fastener 8.

The interchangeable cap 6 is the main visible part of a button assembly that registers with an external base thread 16 on base button 7, interlocking the two parts. The interchangeable cap 6 is the main visible part of a button assembly that allows a user a wide selection of different designs, materials and/or functions. Although interchangeable cap 6 shown in the preferred embodiment is relatively simple in design, its appearance can greatly be varied without departing from the teachings of the present invention. For example, interchangeable cap 6 can be contoured to replicate a traditional sewn on button design for fashion purposes. Similarly, interchangeable cap face 10 can be coated with reflective material for use as a removable safety function in hazardous situations. Interchangeable cap 6 can also be formed to provide a wide range of different colors, functions, shapes, sizes and patterns.

Referring to FIGS. 1A-1D, 1J, and 1K, the interchangeable cap 6 has a cap face 10 on a first side and a recessed inner cap 13 on a second side. The recessed inner cap 13 has an internal cap thread 12 within the inner cap 13. A beveled cap edge 11 surrounds the recessed inner cap 13 and provides a softer contour for ease of passage through fabric buttonholes. At the center of inner cap 13 are prong tracks 14 which provide room for prong tips 19 of the pronged fastener 8 and can accommodate prong tips 19 of the pronged fastener 8 in a maximum tightened position.

A pronged fastener 8 has a fastener base 21 with a beveled fastener edge 22. The beveled fastener edge 22 maintains a soft contour for user handling. On one side of the fastener base 21 is an embossed design 23 and a company logo 24. Embossed designs 23 are embossed on fastener base 21 of the pronged fastener 8 and are used by a user for gripping and to create greater torque when changing interchangeable cap 6. Embossed designs vary in design and are situated on the rear face of fastener base 21 providing grip for stability and counter torque between the base button 7 and the interchangeable cap 6. In addition, company logo 24 also varies in design and is for example purposes and may be engraved for product identification and authenticity.

On the opposite side of the fastener base 21 are prong shafts 20 with prong tips 19 which extend from the fastener base 21. The prong shafts 20 and associated prong tips 19 are in alignment with base buttonholes 15 of the base button 7 that pass from the front side shown in FIG. 1A, to the backside of base button 7.

A base button 7 has a first front side and a second back side with a plurality of base buttonholes 15 which extend from the first front side to the second back side. The second back side has a convex base back 17 containing a plurality of base button holes 15 and external base thread 16 that securely fastens counterpart internal screw thread 16 on the interchangeable cap 6. The external base thread 16 on the outer perimeter of base button 7 encompasses the inner base button 18 containing a plurality of base buttonholes 15, which are aligned with pronged fastener 8. Base buttonholes 15 create pathways for prong tips 19 and prong shafts 20, coupling pronged fastener 8 with base button 7.

Figure 1C:
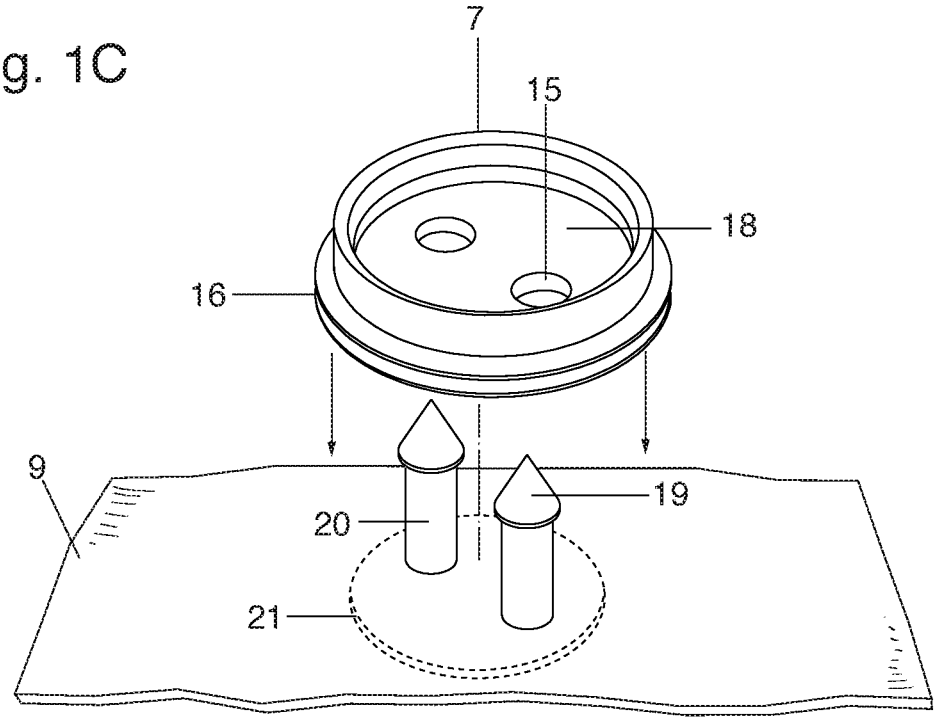
FIG. 1C shows an expanded top view illustrating fabric penetration of the pronged fastener with alignment of the base buttonholes.

FIG. 1C shows an expanded top view of prong tips 19 and prong shafts 20 penetrating fabric 9 in position for fastening with base buttonholes 15. Penetration of pronged fastener 8 is achieved by means of applying pressure to the fastener base 21 shown hidden in view. Upon registration of prong tips 19 and buttonholes 15, compression is applied snappingly interlocking pronged fastener 8 with base button 7 shown in FIG. 1D.

Figure 1D:
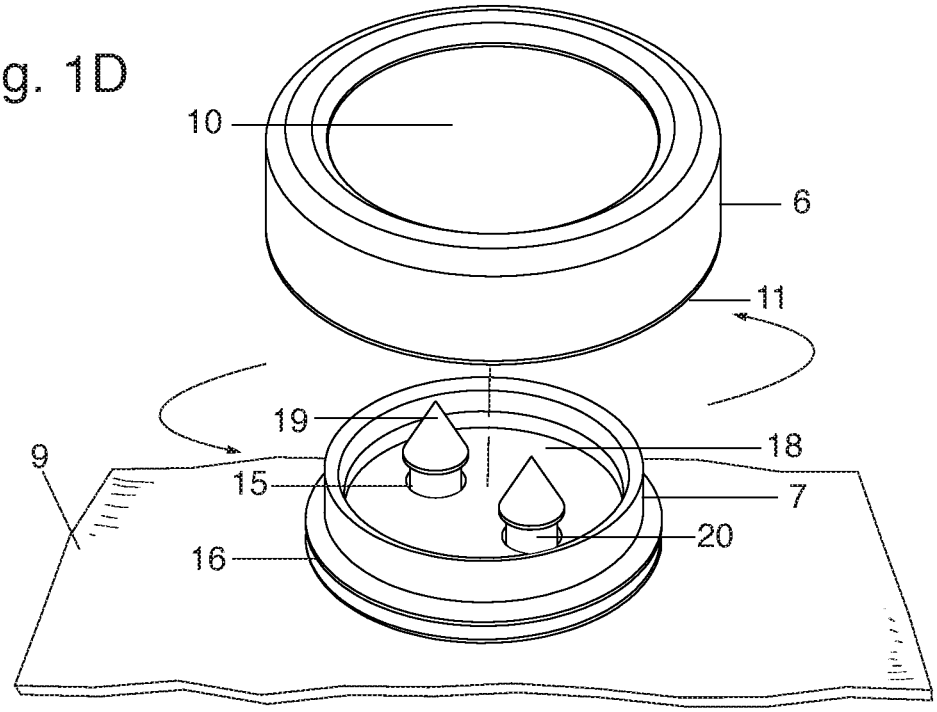
FIG. 1D shows an expanded top view illustrating assembly of the pronged fastener and the button base attached to fabric with alignment of the interchangeable cap.

FIG. 1D shows an expanded top view of button base 7 fastened to fabric 9 by means of pronged fastener 8 in alignment with interchangeable cap 6. Arrows illustrate torquing motion for coupling upon registration of external base thread 16 and internal cap thread 12 (shown in FIG. 1B). As can be seen prong tips 19 are sheathed within inner base button 18 by its outer walls for user safety.

Figure 1E:
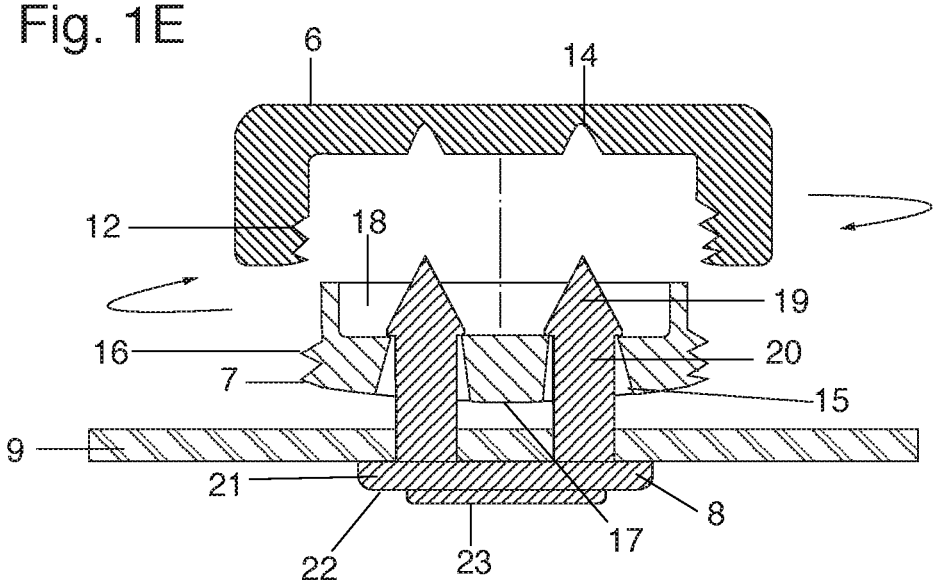
FIG. 1E shows a lateral cross-sectional view of FIG. 1D, showing assembly of the fastener and the button base attached to fabric with alignment of the interchangeable cap.
Figure 1F:
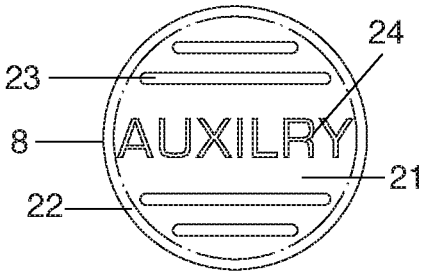
FIG. 1F shows a back view of the pronged fastener.
Figure 1G:
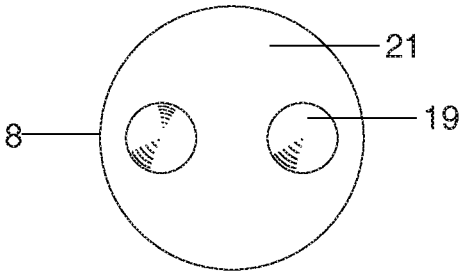
FIG. 1G shows a front view of the pronged fastener.
Figure 1H:
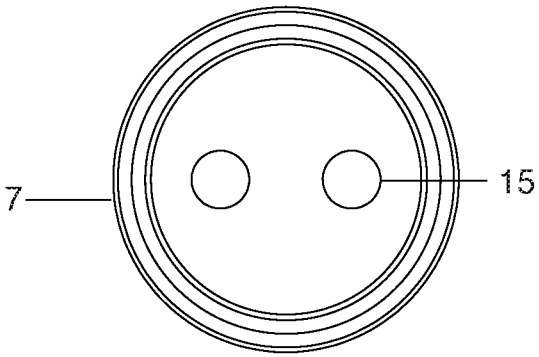
FIG. 1H shows a front view of the base button.
Figure 1I:
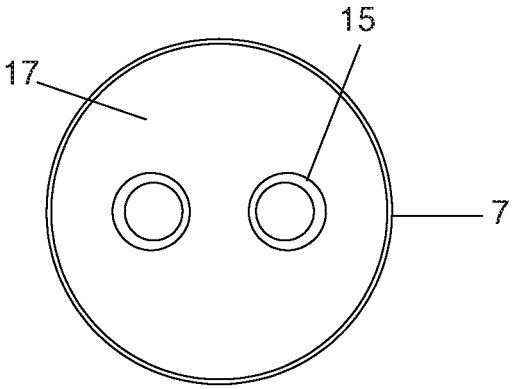
FIG. 1I shows a back view of the base button.
Figure 1J:
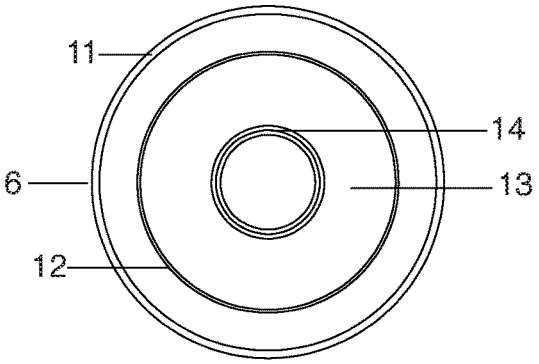
FIG. 1J shows a back view of the interchangeable cap.
Figure 1K:
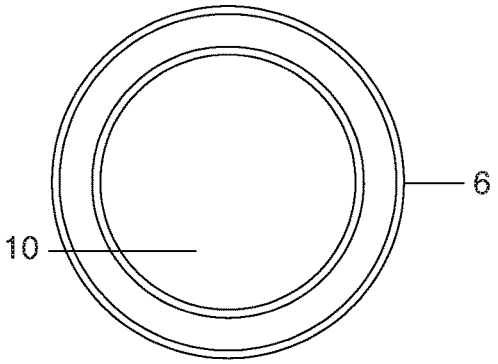
FIG. 1K shows a front view of the interchangeable cap.

FIG. 1E is a lateral cross-sectional view of FIG. 1D, showing a full structural schematic of all components. While shown on one side of fabric 9, fastener base 21 creates support for maximum penetration of prong tips 19 and prong shafts 20 when applying pressure. The user can simply apply pressure with a finger causing the prong tips 19 to penetrate the fabric.

FIGS. 2A-2F show an interchangeable button system of a second embodiment of the present invention. The base button 7 has at least one helical track 25 with a locking groove 34 on an outer perimeter which receives a locking pin or protrusion 26 on the interchangeable cap 6. As in the first embodiment, the inner base button 18 of the base button 7 contains a plurality of base buttonholes 15 aligned with pronged fastener 8. Base buttonholes 15 create pathways for prong tips 19 and prong shafts 20 coupling with the pronged fastener 8.

Figure 2A:
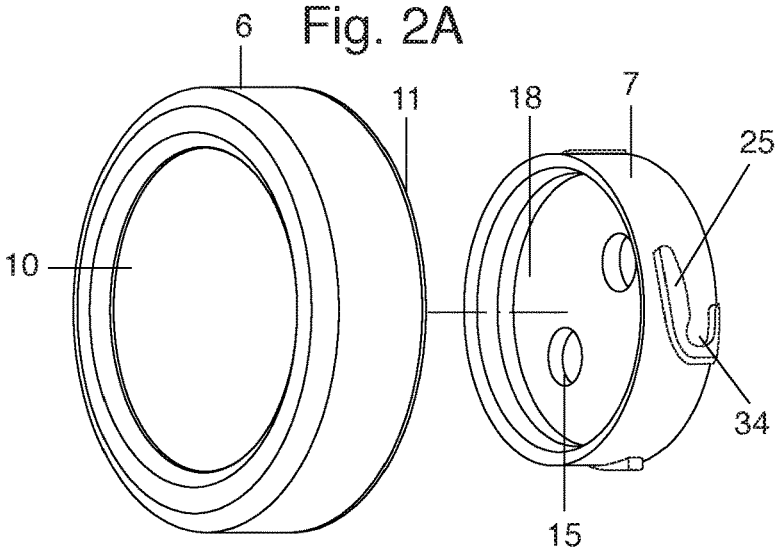
FIG. 2A shows an expanded front view of the interchangeable cap and base button of a second embodiment of the present invention.
Figure 2B:
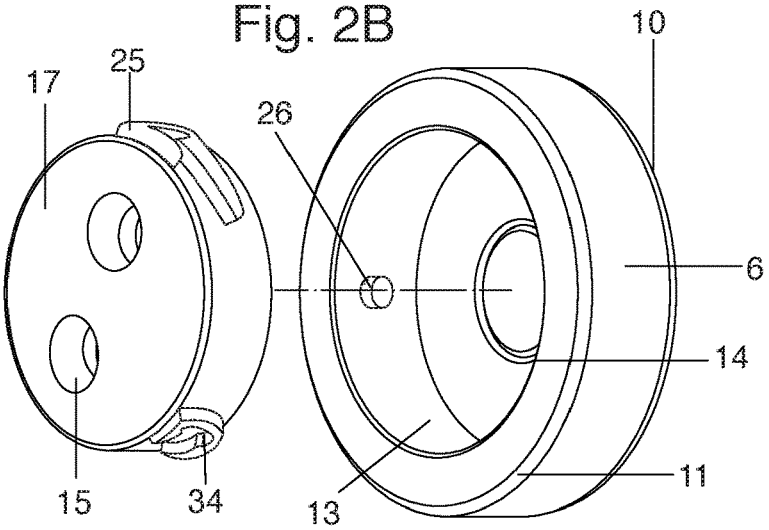
FIG. 2B shows an expanded back view of the interchangeable cap and base button of a second embodiment of the present invention.
Figure 2C:
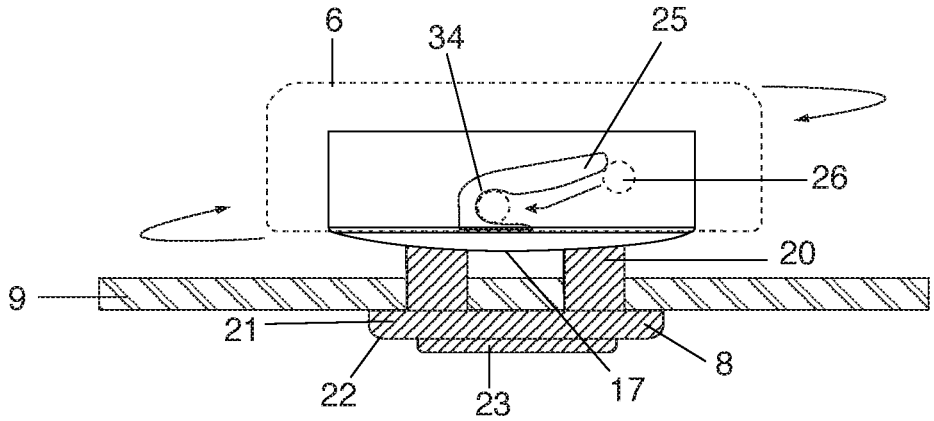
FIG. 2C shows a lateral cross-sectional view of the interchangeable cap moving the bolt along the helical track into locking position completely assembling the invention of a second embodiment of the present invention.
Figure 2D:
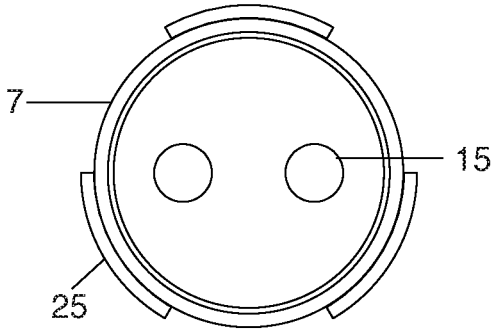
FIG. 2D shows a front view of the base button of the second embodiment of the present invention.
Figure 2E:
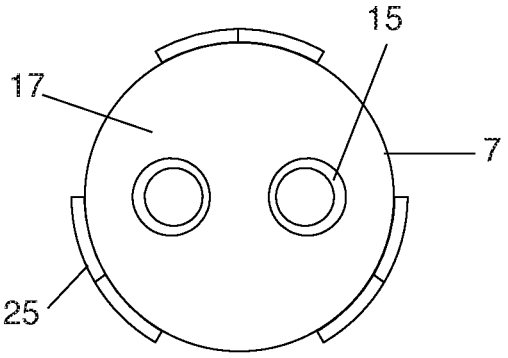
FIG. 2E shows a back view of the base button of the second embodiment of the present invention.
Figure 2F:
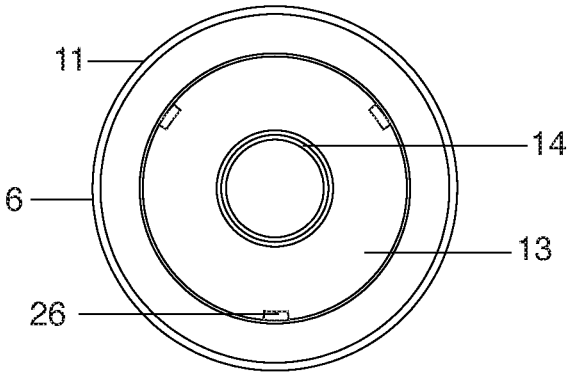
FIG. 2F shows a back view of the interchangeable cap of the second embodiment of the present invention.

FIG. 2C is a lateral cross-sectional view of the second embodiment of the present invention with the interchangeable cap 6 and button base 7 attached to fabric 9 by prong fastener 8. The interchangeable cap 6 and locking pin or protrusion 26 are tightened and secured to button base 7. Further shown are arrows indicating the rotational tightening motion of interchangeable cap 6 in synchronization with the projected path of locking pin 26 along helical track 25. The locking position of the interchangeable cap 6 is achieved when locking pin 26 slides along edge of helical track 25 registering into locking groove 34 (also seen in FIG. 2B). It should be noted that that the prongs tips 19 are not shown in this figure for clarity purposes.

Figure 3A:
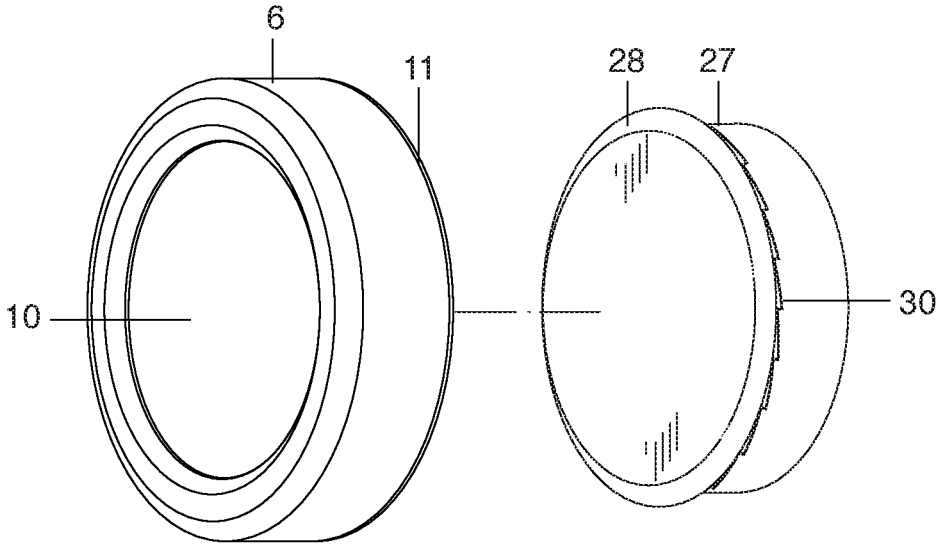
FIG. 3A shows an expanded front view of the two-part interchangeable cap of a third embodiment of the present invention.
Figure 3B:
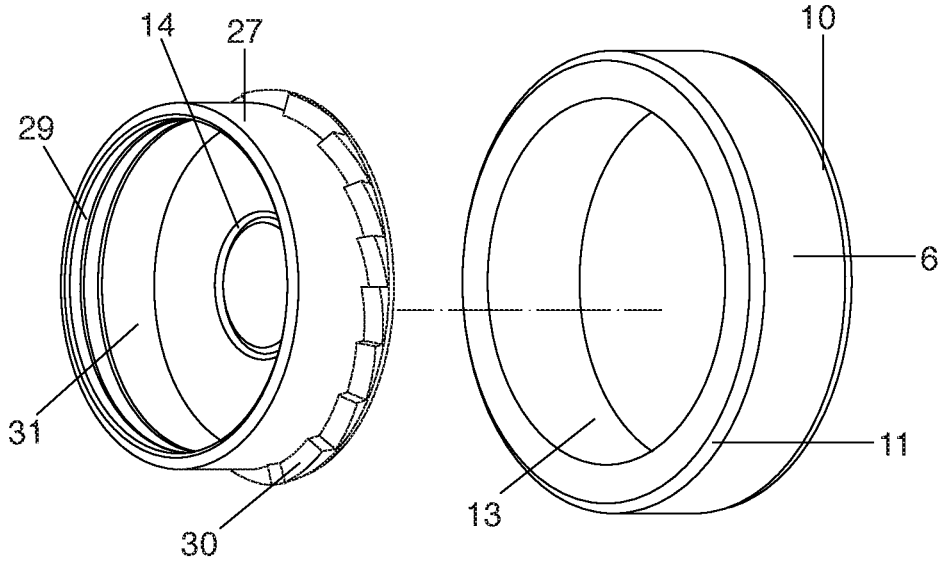
FIG. 3B shows an expanded back view of the two-part interchangeable cap of the third embodiment of the present invention.
Figure 3C:
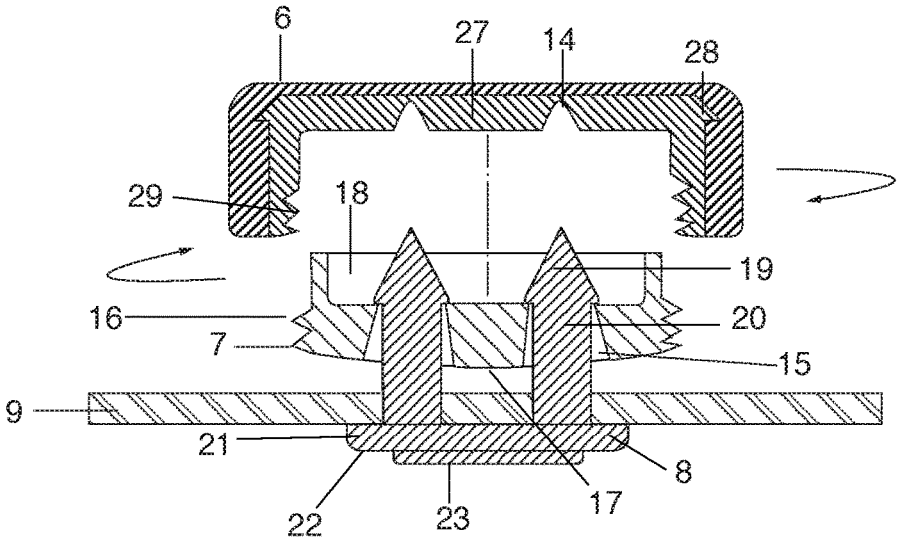
FIG. 3C shows a lateral cross-sectional view of the two-part interchangeable cap of the third embodiment, showing assembly of the fastener and the button base attached to fabric with alignment of the two-part interchangeable cap.

FIG. 3A-3C shows an interchangeable button system of a third embodiment.

In this embodiment, a cap member 27 of the interchangeable cap 6 has a chamfered flange 28 with non-slip teeth 30. Non-slip teeth 30 are used in combination with interchangeable cap 6 to prevent internal spinning of cap member 27 from excessive torque or constant interchange use. The cap member 27 also has internal cap member threads 29 that securely fastens counterpart internal cap thread 12 on base button 7.

The interchangeable button system of the third embodiment may be used when various materials are to be used for interchangeable cap 6 that are different from cap member 27.

Figure 3D:
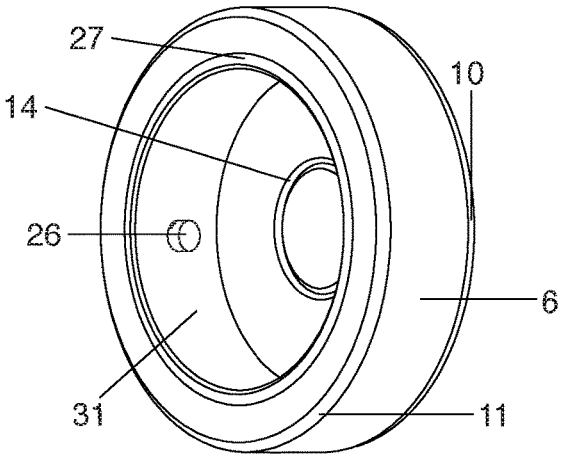
FIG. 3D shows a back view of a two-part interchangeable cap with a locking pin of a fourth embodiment of the present invention.
Figure 3E:
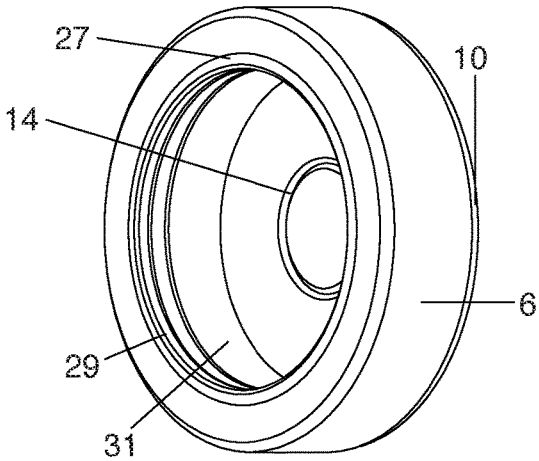
FIG. 3E shows a back view of the assembled two-part interchangeable cap of the fourth embodiment of the present invention.

FIGS. 3D-3E show an interchangeable cap of a fourth embodiment in which the cap member 27 is formed as one piece with the interchangeable cap 6. In FIG. 3D, the one piece interchangeable cap 36 includes a lock pin or protrusion 26 present within the inner cap member 31. In FIG. 3E, the one piece interchangeable cap 36 includes internal cap threads 29 for receiving a button base 7.

Figure 4:
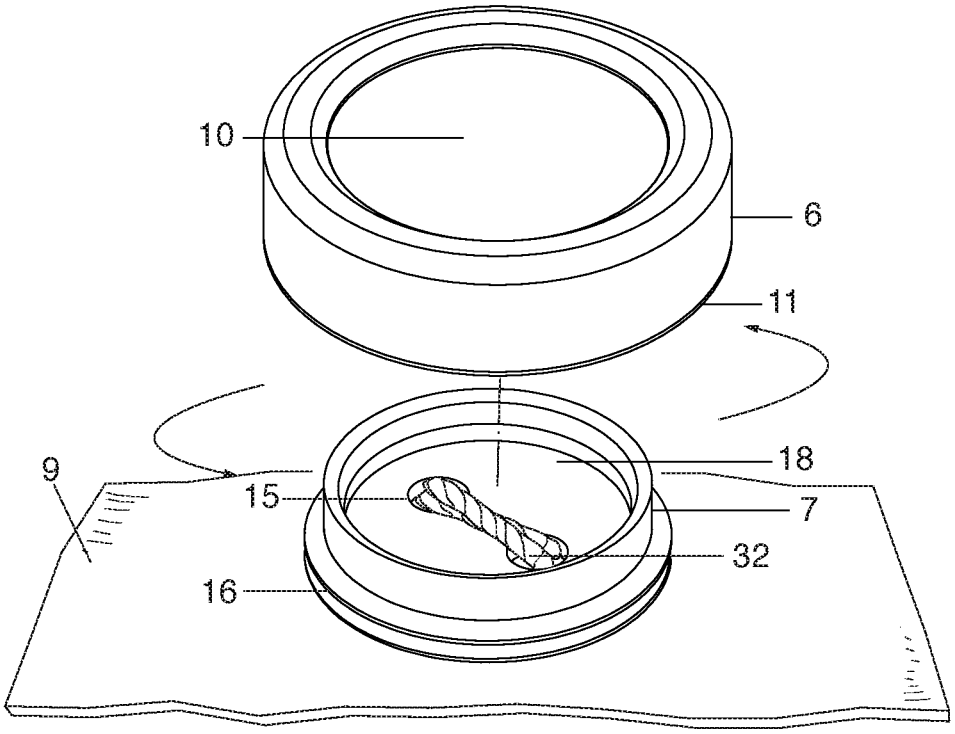
FIG. 4 shows an expanded front view of the interchangeable cap and button base of a fifth embodiment illustrating the button base attached to fabric by means of a sewing method with alignment of the interchangeable cap.

FIG. 4 shows an expanded front view of the interchangeable cap and button base of a fifth embodiment illustrating the button base 7 attached to fabric 9 by means of a sewing method with alignment of the interchangeable cap 6. The button base 7 is fastened to fabric 9 by means of pronged sewing thread 32 in alignment with interchangeable cap 6. Arrows illustrate torquing motion for coupling upon registration of external base thread 16 and internal cap thread 12 (shown in FIG. 1B). As can be seen prong tips 19 are sheathed within inner base button 18 by its outer walls for user safety.

Figure 5:
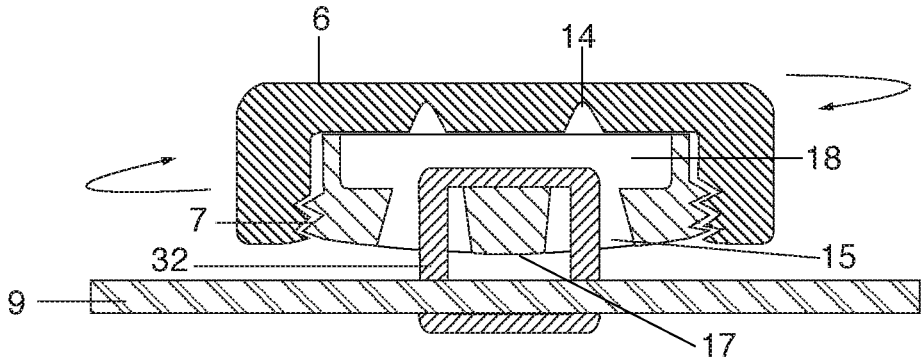
FIG. 5 shows a lateral cross-sectional view of the interchangeable cap and button base of the fifth embodiment of the present invention, showing the button base and interchangeable cap, fully assembled attached to fabric by means of sewing.

FIG. 5 shows a lateral cross-sectional view of the interchangeable cap and button base of the fifth embodiment of the present invention, showing the button base and interchangeable cap, fully assembled attached to fabric by means of sewing. The interchangeable cap 6 and button base 7 are attached to fabric 15 by sewing thread 32 passing through base buttonholes 15. Also shown is interchangeable cap 6 tightened and secured to button base 7 creating vacant space within inner base button 18. Respectively, the sewing method can apply to all alternate embodiments containing a plurality of base buttonholes 15 as an option to the user.

Figure 6:
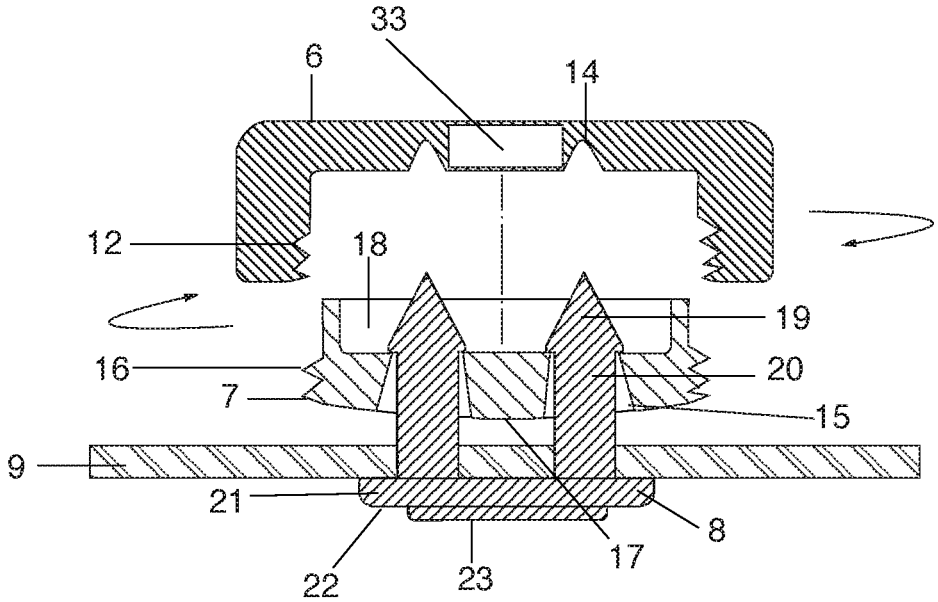
FIG. 6 shows a lateral cross-sectional view of an alternate embodiment where the interchangeable cap is fitted with an independent embedded device fully assembled attached to fabric by means of prong fastener.

FIG. 6 shows a lateral cross-sectional view of an alternate embodiment where the interchangeable cap is fitted with an independent embedded device fully assembled attached to fabric by means of prong fastener. The interchangeable cap 6 is fitted with an independent embedded device 33. Independent embedded device 33 may be representative of any independent device, either self-powered or non-self-powered such as passive radio frequency identification (RFID) tags, near field communication (NFC) devices, microdot devices, light emitting diodes, wireless transceivers, medical devices, active RFID tags or transmitters or the like. The independent embedded device 33 can be mold injected during the manufacturing process or inserted thereafter.

It should be recognized that a benefit of the interchangeable cap of the interchangeable button system of the present invention is that if an interchangeable cap is lost, a wearer is left with a useable base member that resembles a conventional button eliminating damage to the fabric.

| REFERENCE NUMERALS |
|---|
| 6 interchangeable cap |
| 7 base button |
| 8 pronged fastener |
| 9 fabric |
| 10 interchangeable cap face |
| 11 beveled cap edge |
| 12 internal cap thread |
| 13 inner cap |
| 14 prong track |
| 15 base buttonholes |
| 16 external base thread |
| 17 convex base back |
| 18 inner base button |
| 19 prong tip |
| 20 prong shaft |
| 21 fastener base |
| 22 beveled fastener edge |
| 23 embossed design |
| 24 company logo |
| 25 helical track |
| 26 locking pin |
| 27 cap member |
| 28 chamfered flange |
| 29 internal cap member thread |
| 30 non-slip teeth |
| 31 inner cap member |
| 32 sewing thread |
| 33 independent embedded device |
| 34 locking groove |

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An interchangeable button system for use with fabric, comprising:

a fastener comprising a base having a first side comprising a plurality of prongs for extending through fabric and attaching the fastener to the fabric, and a second side;

a base button comprising a mating element on an outer circumference and a plurality of holes for receiving the plurality of prongs of the fastener, such that when the plurality of prongs is received by the plurality of holes, the base button is fastened to the fastener by the prongs; and an interchangeable cap having a first side comprising a cap face and a second side comprising a recessed inner cap having a matching mating element for engaging the mating element of the base button and prong tracks for receiving ends of the plurality of prongs extending from the fastener;

wherein the interchangeable cap is removable from the base button by uncoupling the mating element of the base button from the mating element of the interchangeable cap, allowing the fastener and the base button to remain fixed to the fabric.

2. The interchangeable button system of claim 1, wherein the second side of the interchangeable cap has a beveled outer edge.

3. The interchangeable button system of claim 1, wherein the cap face of the interchangeable cap further comprises a decorative element.

4. The interchangeable button system of claim 1, wherein the second side of the fastener further comprises an embossed portion.

5. The interchangeable button system of claim 1, wherein the base of the fastener further comprises a beveled edge.

6. The interchangeable button system of claim 1, wherein the interchangeable cap further comprises an embedded device.

7. The interchangeable button system of claim 6, wherein the embedded device is a passive communication device.

8. The interchangeable button system of claim 6, wherein the embedded device is selected from the group consisting of a radio frequency identification tag, a near field communication device, a microdot device, a light emitting diode, a medical device, and a wireless transceiver.

9. The interchangeable button system of claim 1, in which the mating element of the base button and the mating element of the interchangeable cap are threads.

10. The interchangeable button system of claim 1, in which the mating element of the base button is a plurality of helical tracks having a lock groove, and the mating element of the interchangeable cap is a plurality of protrusions.

11. An interchangeable button system for use with fabric comprising:

a base button comprising a mating element of a plurality of helical tracks having a lock groove on an outer circumference and a plurality of holes for receiving thread for sewing the button onto the fabric;

an interchangeable cap having a first side comprising a cap face and a second side comprising a recessed inner cap having a matching mating element of a plurality of protrusions for engaging the mating element of the base button;

wherein the interchangeable cap is removable from the base button by uncoupling the mating element of the base button from the mating element of the interchangeable cap, allowing the base button to remain fixed to the fabric.

12. The interchangeable button system of claim 11, wherein the second side of the interchangeable cap has a beveled outer edge.

13. The interchangeable button system of claim 11, wherein the cap face of the interchangeable cap further comprises a decorative element.

14. The interchangeable button system of claim 11, wherein the interchangeable cap further comprises an embedded device.

15. The interchangeable button system of claim 14, wherein the embedded device is a passive communication device.

16. The interchangeable button system of claim 14, wherein the embedded device is selected from the group consisting of a radio frequency identification tag, a near field communication device, a microdot device, a light emitting diode, a medical device, and a wireless transceiver.

* * * * *